US008833315B2

(12) United States Patent
Phillips

(10) Patent No.: US 8,833,315 B2
(45) **Date of Patent: *Sep. 16, 2014**

(54) CROSSOVER PASSAGE SIZING FOR SPLIT-CYCLE ENGINE

(75) Inventor: Ford Allen Phillips, San Antonio, TX (US)

(73) Assignee: Scuderi Group, Inc., West Springfield, MA (US)

( * ) Notice: Subject to any disclaimer, the term of this patent is extended or adjusted under 35 U.S.C. 154(b) by 243 days.

This patent is subject to a terminal disclaimer.

(21) Appl. No.: 13/247,750

(22) Filed: Sep. 28, 2011

(65) Prior Publication Data

US 2012/0073552 A1 Mar. 29, 2012

Related U.S. Application Data

(63) Continuation-in-part of application No. 13/046,840, filed on Mar. 14, 2011.

(60) Provisional application No. 61/404,239, filed on Sep. 29, 2010.

(51) Int. Cl.
*F02B 33/22* (2006.01)

(52) U.S. Cl.
CPC ..... *F02B 33/22* (2013.01)
USPC ..... 123/70 R; 123/68; 123/198 F

(58) Field of Classification Search
USPC ..... 123/68, 70 R, 198 F
See application file for complete search history.

(56) References Cited

U.S. PATENT DOCUMENTS

| | | | | |
|---|---|---|---|---|
| 1,062,999 A | | 5/1913 | Webb | |
| 1,856,048 A | * | 4/1932 | Ahrens | 123/68 |
| 1,936,653 A | | 11/1933 | Almen | |
| 2,109,809 A | | 3/1938 | Van Ranst | |
| 2,394,354 A | | 2/1946 | Barr | |

(Continued)

FOREIGN PATENT DOCUMENTS

| | | |
|---|---|---|
| DE | 10115967 A1 | 10/2002 |
| GB | 2250801 A | 6/1992 |

(Continued)

OTHER PUBLICATIONS

Meldolesi, et al. (Southwest Research Institute), Scuderi Split Cycle Fast Acting Valvetrain: Architecture and Development, SAE paper 2011-01-0404 (Jan. 18, 2011) (23 pages).

(Continued)

*Primary Examiner* — Noah Kamen
(74) *Attorney, Agent, or Firm* — Nutter McClennen & Fish LLP; John J. Penny, Jr.; Michael P. Visconti, III

(57) ABSTRACT

In split-cycle engines and air hybrid split-cycle engines, the sizing of the crossover passage is critical to engine efficiency. Efficiency can be improved by sizing the crossover passage volume to be small relative to the volume of the cylinders, and in particular relative to the volume of the compression cylinder. This allows for a higher pressure in the crossover passage, which extends the duration of sonic flow from the crossover passage into the expansion cylinder and increases combustion pressure. The methods, systems, and devices disclosed herein generally involve sizing the crossover passages, cylinders, or other components of a split-cycle engine or air hybrid split-cycle engine to improve efficiency.

27 Claims, 4 Drawing Sheets

(56) References Cited

U.S. PATENT DOCUMENTS

| | | | | |
|---|---|---|---|---|
| 2,772,667 | A | 12/1956 | Nallinger | |
| 3,209,737 | A | 10/1965 | Isao | |
| 3,675,630 | A * | 7/1972 | Stratton | 123/70 R |
| 3,774,581 | A | 11/1973 | Lundy | |
| 3,786,792 | A | 1/1974 | Pelizzoni et al. | |
| 3,808,818 | A | 5/1974 | Cataldo | |
| 3,880,126 | A | 4/1975 | Thurston et al. | |
| 3,908,701 | A | 9/1975 | Dawawala | |
| 3,938,483 | A | 2/1976 | Firey | |
| 3,949,964 | A | 4/1976 | Freeman | |
| 4,133,172 | A | 1/1979 | Cataldo | |
| 4,224,798 | A | 9/1980 | Brinkerhoff | |
| 4,321,904 | A * | 3/1982 | Bristol | 123/559.1 |
| 4,418,657 | A | 12/1983 | Wishart | |
| 4,506,634 | A * | 3/1985 | Kerrebrock | 123/68 |
| 4,696,158 | A | 9/1987 | DeFrancisco | |
| 4,825,717 | A | 5/1989 | Mills | |
| 4,860,716 | A | 8/1989 | Deutschmann | |
| 4,934,652 | A | 6/1990 | Golden | |
| 5,018,487 | A | 5/1991 | Shinkai | |
| 5,193,495 | A | 3/1993 | Wood, III | |
| 5,265,564 | A * | 11/1993 | Dullaway | 123/70 R |
| 5,402,756 | A | 4/1995 | Bohme et al. | |
| 5,555,861 | A | 9/1996 | Mayr et al. | |
| 5,690,066 | A | 11/1997 | Hampton et al. | |
| 5,713,316 | A | 2/1998 | Sturman | |
| 5,964,087 | A | 10/1999 | Tort-Oropeza | |
| 5,988,124 | A | 11/1999 | Duesmann | |
| 6,152,714 | A | 11/2000 | Mitsuya et al. | |
| 6,192,841 | B1 | 2/2001 | Vorih et al. | |
| 6,216,649 | B1 * | 4/2001 | Laydera-Collins | 123/70 R |
| 6,230,472 | B1 | 5/2001 | Stahlecker | |
| 6,230,742 | B1 | 5/2001 | Bircann | |
| 6,273,057 | B1 | 8/2001 | Schwoerer et al. | |
| 6,302,370 | B1 | 10/2001 | Schwoerer et al. | |
| 6,332,917 | B1 | 12/2001 | Schollkopf | |
| 6,397,579 | B1 | 6/2002 | Negre | |
| 6,412,457 | B1 | 7/2002 | Vorih et al. | |
| 6,415,749 | B1 | 7/2002 | Sturman et al. | |
| 6,474,277 | B1 | 11/2002 | Vanderpoel et al. | |
| 6,510,824 | B2 | 1/2003 | Vorih et al. | |
| 6,543,225 | B2 | 4/2003 | Scuderi | |
| 6,584,885 | B2 | 7/2003 | Lou | |
| 6,609,371 | B2 | 8/2003 | Scuderi | |
| 6,647,954 | B2 | 11/2003 | Yang et al. | |
| 6,655,327 | B1 | 12/2003 | Hedman | |
| 6,874,453 | B2 | 4/2005 | Coney et al. | |
| 6,883,775 | B2 | 4/2005 | Coney et al. | |
| 6,952,923 | B2 | 10/2005 | Branyon et al. | |
| 7,140,332 | B2 | 11/2006 | Klein et al. | |
| 7,156,062 | B2 | 1/2007 | Vanderpoel | |
| 7,171,930 | B2 | 2/2007 | Keel | |
| 7,353,786 | B2 | 4/2008 | Scuderi et al. | |
| 7,481,190 | B2 | 1/2009 | Scuderi | |
| 7,513,224 | B2 | 4/2009 | Heaton | |
| 7,536,984 | B2 | 5/2009 | Lou | |
| 7,588,001 | B2 | 9/2009 | Branyon et al. | |
| 7,603,970 | B2 | 10/2009 | Scuderi et al. | |
| 7,628,126 | B2 | 12/2009 | Scuderi | |
| 7,637,234 | B2 | 12/2009 | Tussing et al. | |
| 7,690,337 | B2 | 4/2010 | Pirault et al. | |
| 7,810,459 | B2 | 10/2010 | Branyon et al. | |
| 7,823,547 | B2 | 11/2010 | Forner, Sr. et al. | |
| 7,950,357 | B2 | 5/2011 | Kreuter | |
| 7,963,259 | B2 | 6/2011 | Meldolesi et al. | |
| 2002/0185091 | A1 | 12/2002 | Vorih et al. | |
| 2005/0022768 | A1 | 2/2005 | Tores et al. | |
| 2005/0132987 | A1 | 6/2005 | Chang | |
| 2005/0268609 | A1 | 12/2005 | Branyon et al. | |
| 2006/0243229 | A1 | 11/2006 | Zajac | |
| 2006/0273271 | A1 | 12/2006 | Yang et al. | |
| 2007/0157894 | A1 | 7/2007 | Scuderi et al. | |
| 2008/0054205 | A1 | 3/2008 | Lou | |
| 2008/0105225 | A1 | 5/2008 | Scuderi et al. | |
| 2008/0202454 | A1 | 8/2008 | Pirault | |
| 2008/0251041 | A1 | 10/2008 | Lou | |
| 2009/0038596 | A1 | 2/2009 | Pirault et al. | |
| 2009/0038598 | A1 | 2/2009 | Phillips | |
| 2009/0044778 | A1 | 2/2009 | Scuderi et al. | |
| 2009/0133648 | A1 | 5/2009 | Lou | |
| 2010/0126442 | A1 | 5/2010 | Lou | |
| 2010/0180847 | A1 | 7/2010 | Meldolesi et al. | |
| 2010/0180848 | A1 | 7/2010 | Meldolesi et al. | |
| 2010/0236534 | A1 | 9/2010 | Scuderi et al. | |
| 2010/0263646 | A1 | 10/2010 | Giannini et al. | |
| 2010/0282225 | A1 | 11/2010 | Gilbert et al. | |
| 2010/0300385 | A1 | 12/2010 | Durrett et al. | |
| 2011/0220083 | A1 | 9/2011 | Meldolesi et al. | |
| 2011/0303202 | A1 | 12/2011 | Moser et al. | |

FOREIGN PATENT DOCUMENTS

| | | | |
|---|---|---|---|
| GB | 2340881 | A | 3/2000 |
| JP | 40-010860 | A | 4/1965 |
| JP | 01-315631 | A | 12/1989 |
| JP | 02-207131 | A | 8/1990 |
| JP | 04-076234 | A | 3/1992 |
| JP | 06-173702 | A | 6/1994 |
| JP | 08-507844 | A | 8/1996 |
| JP | 08-284668 | A | 10/1996 |
| JP | 10-274105 | A | 10/1998 |
| JP | 11-022473 | A | 1/1999 |
| JP | 2001-227368 | A | 8/2001 |
| JP | 2001-304014 | A | 10/2001 |
| JP | 2004-239065 | A | 8/2004 |
| JP | 2004-293695 | A | 10/2004 |
| JP | 2006-528741 | A | 12/2006 |
| JP | 2007-521439 | A | 8/2007 |
| JP | 04-166656 | B2 | 10/2008 |
| KR | 10-2010-0028666 | A | 3/2010 |
| WO | 03/046347 | A1 | 6/2003 |
| WO | 2005/010329 | A2 | 2/2005 |
| WO | 2005/042942 | A1 | 5/2005 |
| WO | 2006094213 | A1 | 9/2006 |
| WO | 2009083182 | | 7/2009 |

OTHER PUBLICATIONS

Phillips, et al. (Southwest Research Institute), Scuderi Split Cycle Research Engine: Overview, Architecture and Operation, SAE paper 2011-01-0403 (Jan. 18, 2011) (21 pages).

Urata, et al. (Honda), A Study of Vehicle Equipped with Non-Throttling S.I. Engine with Early Intake Valve Closing Mechanism, SAE paper 930820 (Mar. 1, 1993) (13 pages).

International Search Report and Written Opinion for Application No. PCT/US2011/053720 mailed Dec. 23, 2013 (21 Pages).

Japanese Office Action for Application No. 2013-531772 issued Jun. 24, 2014 (15 pages).

* cited by examiner

CROSSOVER PASSAGE SIZING FOR SPLIT-CYCLE ENGINE

CROSS-REFERENCE TO RELATED APPLICATIONS

This application claims the benefit of priority of U.S. Provisional Patent Application No. 61/404,239, filed on Sep. 29, 2010, the entire contents of which are incorporated herein by reference. This application also claims the benefit of priority of U.S. patent application Ser. No. 13/046,840, filed on Mar. 14, 2011, the entire contents of which are incorporated herein by reference.

FIELD

The present invention relates to internal combustion engines. More particularly, the invention relates to crossover passage sizing for split-cycle engines.

BACKGROUND

For purposes of clarity, the term "conventional engine" as used in the present application refers to an internal combustion engine wherein all four strokes of the well-known Otto cycle (the intake, compression, expansion and exhaust strokes) are contained in each piston/cylinder combination of the engine. Each stroke requires one half revolution of the crankshaft (180 degrees crank angle ("CA")), and two full revolutions of the crankshaft (720 degrees CA) are required to complete the entire Otto cycle in each cylinder of a conventional engine.

Also, for purposes of clarity, the following definition is offered for the term "split-cycle engine" as may be applied to engines disclosed in the prior art and as referred to in the present application.

A split-cycle engine generally comprises:

a crankshaft rotatable about a crankshaft axis;

a compression piston slidably received within a compression cylinder and operatively connected to the crankshaft such that the compression piston reciprocates through an intake stroke and a compression stroke during a single rotation of the crankshaft;

an expansion (power) piston slidably received within an expansion cylinder and operatively connected to the crankshaft such that the expansion piston reciprocates through an expansion stroke and an exhaust stroke during a single rotation of the crankshaft; and a crossover passage interconnecting the compression and expansion cylinders, the crossover passage including at least a crossover expansion (XovrE) valve disposed therein, but more preferably including a crossover compression (XovrC) valve and a crossover expansion (XovrE) valve defining a pressure chamber therebetween.

A split-cycle air hybrid engine combines a split-cycle engine with an air reservoir (also commonly referred to as an air tank) and various controls. This combination enables the engine to store energy in the form of compressed air in the air reservoir. The compressed air in the air reservoir is later used in the expansion cylinder to power the crankshaft. In general, a split-cycle air hybrid engine as referred to herein comprises:

a crankshaft rotatable about a crankshaft axis;

a compression piston slidably received within a compression cylinder and operatively connected to the crankshaft such that the compression piston reciprocates through an intake stroke and a compression stroke during a single rotation of the crankshaft;

an expansion (power) piston slidably received within an expansion cylinder and operatively connected to the crankshaft such that the expansion piston reciprocates through an expansion stroke and an exhaust stroke during a single rotation of the crankshaft;

a crossover passage (port) interconnecting the compression and expansion cylinders, the crossover passage including at least a crossover expansion (XovrE) valve disposed therein, but more preferably including a crossover compression (XovrC) valve and a crossover expansion (XovrE) valve defining a pressure chamber therebetween; and an air reservoir operatively connected to the crossover passage and selectively operable to store compressed air from the compression cylinder and to deliver compressed air to the expansion cylinder.

FIG. 1 illustrates one exemplary embodiment of a prior art split-cycle air hybrid engine. The split-cycle engine 100 replaces two adjacent cylinders of a conventional engine with a combination of one compression cylinder 102 and one expansion cylinder 104. The compression cylinder 102 and the expansion cylinder 104 are formed in an engine block in which a crankshaft 106 is rotatably mounted. Upper ends of the cylinders 102, 104 are closed by a cylinder head 130. The crankshaft 106 includes axially displaced and angularly offset first and second crank throws 126, 128, having a phase angle therebetween. The first crank throw 126 is pivotally joined by a first connecting rod 138 to a compression piston 110, and the second crank throw 128 is pivotally joined by a second connecting rod 140 to an expansion piston 120 to reciprocate the pistons 110, 120 in their respective cylinders 102, 104 in a timed relation determined by the angular offset of the crank throws and the geometric relationships of the cylinders, crank, and pistons. Alternative mechanisms for relating the motion and timing of the pistons can be utilized if desired. The rotational direction of the crankshaft and the relative motions of the pistons near their bottom dead center (BDC) positions are indicated by the arrows associated in the drawings with their corresponding components.

The four strokes of the Otto cycle are thus "split" over the two cylinders 102 and 104 such that the compression cylinder 102 contains the intake and compression strokes and the expansion cylinder 104 contains the expansion and exhaust strokes. The Otto cycle is therefore completed in these two cylinders 102, 104 once per crankshaft 106 revolution (360 degrees CA).

During the intake stroke, intake air is drawn into the compression cylinder 102 through an inwardly-opening (opening inward into the cylinder and toward the piston) poppet intake valve 108. During the compression stroke, the compression piston 110 pressurizes the air charge and drives the air charge through a crossover passage 112, which acts as the intake passage for the expansion cylinder 104. The engine 100 can have one or more crossover passages 112.

The volumetric (or geometric) compression ratio of the compression cylinder 102 of the split-cycle engine 100 (and for split-cycle engines in general) is herein referred to as the "compression ratio" of the split-cycle engine. The volumetric (or geometric) compression ratio of the expansion cylinder 104 of the engine 100 (and for split-cycle engines in general) is herein referred to as the "expansion ratio" of the split-cycle engine. The volumetric compression ratio of a cylinder is well known in the art as the ratio of the enclosed (or trapped) volume in the cylinder (including all recesses) when a piston reciprocating therein is at its BDC position to the enclosed volume (i.e., clearance volume) in the cylinder when said piston is at its top dead center (TDC) position. Specifically for split-cycle engines as defined herein, the compression ratio of a compression cylinder is determined when the XovrC valve is closed. Also specifically for split-cycle engines as defined herein, the expansion ratio of an expansion cylinder is determined when the XovrE valve is closed.

Due to very high volumetric compression ratios (e.g., 20 to 1, 30 to 1, 40 to 1, or greater) within the compression cylinder 102, an outwardly-opening (opening outwardly away from the cylinder and piston) poppet crossover compression (XovrC) valve 114 at the inlet of the crossover passage 112 is used to control flow from the compression cylinder 102 into the crossover passage 112. Due to very high volumetric compression ratios (e.g., 20 to 1, 30 to 1, 40 to 1, or greater) within the expansion cylinder 104, an outwardly-opening poppet crossover expansion (XovrE) valve 116 at the outlet of the crossover passage 112 controls flow from the crossover passage 112 into the expansion cylinder 104. The actuation rates and phasing of the XovrC and XovrE valves 114, 116 are timed to maintain pressure in the crossover passage 112 at a high minimum pressure (typically 20 bar or higher at full load) during all four strokes of the Otto cycle.

At least one fuel injector 118 injects fuel into the pressurized air at the exit end of the crossover passage 112 in coordination with the XovrE valve 116 opening. Alternatively, or in addition, fuel can be injected directly into the expansion cylinder 104. The fuel-air charge fully enters the expansion cylinder 104 shortly after the expansion piston 120 reaches its TDC position. As the piston 120 begins its descent from its TDC position, and while the XovrE valve 116 is still open, one or more spark plugs 122 are fired to initiate combustion (typically between 10 to 20 degrees CA after TDC of the expansion piston 120). Combustion can be initiated while the expansion piston is between 1 and 30 degrees CA past its TDC position. More preferably, combustion can be initiated while the expansion piston is between 5 and 25 degrees CA past its TDC position. Most preferably, combustion can be initiated while the expansion piston is between 10 and 20 degrees CA past its TDC position. Additionally, combustion can be initiated through other ignition devices and/or methods, such as with glow plugs, microwave ignition devices, or through compression ignition methods.

The XovrE valve 116 is then closed before the resulting combustion event enters the crossover passage 112. The combustion event drives the expansion piston 120 downward in a power stroke. Exhaust gases are pumped out of the expansion cylinder 104 through an inwardly-opening poppet exhaust valve 124 during the exhaust stroke.

With the split-cycle engine concept, the geometric engine parameters (i.e., bore, stroke, connecting rod length, compression ratio, etc.) of the compression and expansion cylinders are generally independent from one another. For example, the crank throws 126, 128 for the compression cylinder 102 and expansion cylinder 104, respectively, have different radii and are phased apart from one another with TDC of the expansion piston 120 occurring prior to TDC of the compression piston 110. This independence enables the split-cycle engine to potentially achieve higher efficiency levels and greater torques than typical four-stroke engines.

The geometric independence of engine parameters in the split-cycle engine 100 is also one of the main reasons why pressure can be maintained in the crossover passage 112 as discussed earlier. Specifically, the expansion piston 120 reaches its TDC position prior to the compression piston 110 reaching its TDC position by a discrete phase angle (typically between 10 and 30 crank angle degrees). This phase angle, together with proper timing of the XovrC valve 114 and the XovrE valve 116, enables the split-cycle engine 100 to maintain pressure in the crossover passage 112 at a high minimum pressure (typically 20 bar absolute or higher during full load operation) during all four strokes of its pressure/volume cycle. That is, the split-cycle engine 100 is operable to time the XovrC valve 114 and the XovrE valve 116 such that the XovrC and XovrE valves 114, 116 are both open for a substantial period of time (or period of crankshaft rotation) during which the expansion piston 120 descends from its TDC position towards its BDC position and the compression piston 110 simultaneously ascends from its BDC position towards its TDC position. During the period of time (or crankshaft rotation) that the crossover valves 114, 116 are both open, a substantially equal mass of gas is transferred (1) from the compression cylinder 102 into the crossover passage 112 and (2) from the crossover passage 112 to the expansion cylinder 104. Accordingly, during this period, the pressure in the crossover passage is prevented from dropping below a predetermined minimum pressure (typically 20, 30, or 40 bar absolute during full load operation). Moreover, during a substantial portion of the intake and exhaust strokes (typically 90% of the entire intake and exhaust strokes or greater), the XovrC valve 114 and XovrE valve 116 are both closed to maintain the mass of trapped gas in the crossover passage 112 at a substantially constant level. As a result, the pressure in the crossover passage 112 is maintained at a predetermined minimum pressure during all four strokes of the engine's pressure/volume cycle.

For purposes herein, the method of opening the XovrC 114 and XovrE 116 valves while the expansion piston 120 is descending from TDC and the compression piston 110 is ascending toward TDC in order to simultaneously transfer a substantially equal mass of gas into and out of the crossover passage 112 is referred to as the "push-pull" method of gas transfer. It is the push-pull method that enables the pressure in the crossover passage 112 of the engine 100 to be maintained at typically 20 bar or higher during all four strokes of the engine's cycle when the engine is operating at full load.

The crossover valves 114, 116 are actuated by a valve train that includes one or more cams (not shown). In general, a cam-driven mechanism includes a camshaft mechanically linked to the crankshaft. One or more cams are mounted to the camshaft, each having a contoured surface that controls the valve lift profile of the valve event (i.e., the event that occurs during a valve actuation). The XovrC valve 114 and the XovrE valve 116 each can have its own respective cam and/or its own respective camshaft. As the XovrC and XovrE cams rotate, eccentric portions thereof impart motion to a rocker arm, which in turn imparts motion to the valve, thereby lifting (opening) the valve off of its valve seat. As the cam continues to rotate, the eccentric portion passes the rocker arm and the valve is allowed to close.

For purposes herein, a valve event (or valve opening event) is defined as the valve lift from its initial opening off of its valve seat to its closing back onto its valve seat versus rotation of the crankshaft during which the valve lift occurs. Also, for purposes herein, the valve event duration is the duration in time or degrees CA required for the valve event to occur within a given engine cycle. It is important to note that a valve event is generally only a fraction of the total duration of an engine operating cycle (e.g., 720 degrees CA for a conventional four-stroke engine cycle and 360 degrees CA for a split-cycle engine).

The split-cycle air hybrid engine 100 also includes an air reservoir (tank) 142, which is operatively connected to the crossover passage 112 by an air reservoir tank valve 152. Embodiments with two or more crossover passages 112 may include a tank valve 152 for each crossover passage 112 which connect to a common air reservoir 142, may include a single valve which connects all crossover passages 112 to a common air reservoir 142, or each crossover passage 112 may operatively connect to separate air reservoirs 142.

The tank valve 152 is typically disposed in an air tank port 154, which extends from the crossover passage 112 to the air tank 142. The air tank port 154 is divided into a first air tank port section 156 and a second air tank port section 158. The first air tank port section 156 connects the air tank valve 152 to the crossover passage 112, and the second air tank port section 158 connects the air tank valve 152 to the air tank 142. The volume of the first air tank port section 156 includes the volume of all additional recesses which connect the tank valve 152 to the crossover passage 112 when the tank valve 152 is closed. Preferably, the volume of the first air tank port section 156 is small relative to the second air tank port section 158. More preferably, the first air tank port section 156 is substantially non-existent, that is, the tank valve 152 is most preferably disposed such that it is flush against the outer wall of the crossover passage 112.

The tank valve 152 may be any suitable valve device or system. For example, the tank valve 152 may be an active valve which is activated by various valve actuation devices (e.g., pneumatic, hydraulic, cam, electric, or the like). Additionally, the tank valve 152 may comprise a tank valve system with two or more valves actuated with two or more actuation devices.

The air tank 142 is utilized to store energy in the form of compressed air and to later use that compressed air to power the crankshaft 106. This mechanical means for storing potential energy provides numerous potential advantages over the current state of the art. For instance, the split-cycle air hybrid engine 100 can potentially provide many advantages in fuel efficiency gains and NOx emissions reduction at relatively low manufacturing and waste disposal costs in relation to other technologies on the market, such as diesel engines and electric-hybrid systems.

The engine 100 typically runs in a normal operating or firing (NF) mode (also commonly called the engine firing (EF) mode) and one or more of four basic air hybrid modes. In the EF mode, the engine 100 functions normally as previously described in detail herein, operating without the use of the air tank 142. In the EF mode, the air tank valve 152 remains closed to isolate the air tank 142 from the basic split-cycle engine. In the four air hybrid modes, the engine 100 operates with the use of the air tank 142.

The four basic air hybrid modes include:

1) Air Expander (AE) mode, which includes using compressed air energy from the air tank 142 without combustion;

2) Air Compressor (AC) mode, which includes storing compressed air energy into the air tank 142 without combustion;

3) Air Expander and Firing (AEF) mode, which includes using compressed air energy from the air tank 142 with combustion; and 4) Firing and Charging (FC) mode, which includes storing compressed air energy into the air tank 142 with combustion.

Further details on split-cycle engines can be found in U.S. Pat. No. 6,543,225 entitled Split Four Stroke Cycle Internal Combustion Engine and issued on Apr. 8, 2003; and U.S. Pat. No. 6,952,923 entitled Split-Cycle Four-Stroke Engine and issued on Oct. 11, 2005, each of which is incorporated by reference herein in its entirety.

Further details on air hybrid engines are disclosed in U.S. Pat. No. 7,353,786 entitled Split-Cycle Air Hybrid Engine and issued on Apr. 8, 2008; U.S. Patent Application No. 61/365,343 entitled Split-Cycle Air Hybrid Engine and filed on Jul. 18, 2010; and U.S. Patent Application No. 61/313,831 entitled Split-Cycle Air Hybrid Engine and filed on Mar. 15, 2010, each of which is incorporated by reference herein in its entirety.

SUMMARY

In split-cycle engines and air hybrid split-cycle engines, the sizing of the crossover passage is critical to engine efficiency. Efficiency can be improved by sizing the crossover passage volume to be small relative to the volume of the cylinders, and in particular relative to the volume of the compression cylinder. This allows for a higher pressure in the crossover passage, which extends the duration of sonic flow from the crossover passage into the expansion cylinder and increases combustion pressure. The methods, systems, and devices disclosed herein generally involve sizing the crossover passages, cylinders, or other components of a split-cycle engine or air hybrid split-cycle engine to improve efficiency.

In one aspect of at least one embodiment of the invention, an engine is provided that includes a crankshaft rotatable about a crankshaft axis, a compression piston slidably received within a compression cylinder and operatively connected to the crankshaft such that the compression piston reciprocates through an intake stroke and a compression stroke during a single rotation of the crankshaft, and an expansion piston slidably received within an expansion cylinder and operatively connected to the crankshaft such that the expansion piston reciprocates through an expansion stroke and an exhaust stroke during a single rotation of the crankshaft. The engine also includes a crossover passage interconnecting the compression and expansion cylinders, the crossover passage including at least one valve. The maximum volume of the compression cylinder is at least 2 times greater than the volume of the crossover passage.

Related aspects of at least one embodiment of the invention provide an engine, e.g., as described above, in which the maximum volume of the compression cylinder is at least 4 times greater than, at least 6 times greater than, and/or at least 8 times greater than the volume of the crossover passage.

Related aspects of at least one embodiment of the invention provide an engine, e.g., as described above, in which the maximum volume of the compression cylinder is about 9.5 times greater than the volume of the crossover passage.

Related aspects of at least one embodiment of the invention provide an engine, e.g., as described above, in which the crossover passage comprises a plurality of crossover passages. In one embodiment, each of the plurality of crossover passages can be selectively deactivated to reduce an overall volume of the crossover passage.

In another aspect of at least one embodiment of the invention, an engine is provided that includes a crankshaft rotatable about a crankshaft axis, a compression piston slidably received within a compression cylinder and operatively connected to the crankshaft such that the compression piston reciprocates through an intake stroke and a compression stroke during a single rotation of the crankshaft, and an expansion piston slidably received within an expansion cylinder and operatively connected to the crankshaft such that the expansion piston reciprocates through an expansion stroke and an exhaust stroke during a single rotation of the crankshaft. The engine also includes a crossover passage interconnecting the compression and expansion cylinders, the crossover passage including at least one valve. The maximum volume of the expansion cylinder is at least 2 times greater than the volume of the crossover passage.

Related aspects of at least one embodiment of the invention provide an engine, e.g., as described above, in which the maximum volume of the expansion cylinder is at least 4 times greater than, at least 6 times greater than, and/or at least 8 times greater than the volume of the crossover passage.

Related aspects of at least one embodiment of the invention provide an engine, e.g., as described above, in which the maximum volume of the expansion cylinder is about 8.7 times greater than the volume of the crossover passage.

Related aspects of at least one embodiment of the invention provide an engine, e.g., as described above, in which the crossover passage comprises a plurality of crossover passages. In one embodiment, each of the plurality of crossover passages can be selectively deactivated to reduce an overall volume of the crossover passage.

In another aspect of at least one embodiment of the invention, an engine is provided that includes a crankshaft rotatable about a crankshaft axis, a compression piston slidably received within a compression cylinder and operatively connected to the crankshaft such that the compression piston reciprocates through an intake stroke and a compression stroke during a single rotation of the crankshaft, and an expansion piston slidably received within an expansion cylinder and operatively connected to the crankshaft such that the expansion piston reciprocates through an expansion stroke and an exhaust stroke during a single rotation of the crankshaft. The engine also includes a crossover passage interconnecting the compression and expansion cylinders, the crossover passage including at least one valve. The maximum aggregate volume of the compression cylinder and the expansion cylinder is at least 8 times greater than the volume of the crossover passage.

Related aspects of at least one embodiment of the invention provide an engine, e.g., as described above, in which the maximum aggregate volume of the compression cylinder and the expansion cylinder is at least 10 times greater than and/or at least 15 times greater than the volume of the crossover passage.

Related aspects of at least one embodiment of the invention provide an engine, e.g., as described above, in which the maximum aggregate volume of the compression cylinder and the expansion cylinder is about 17.7 times greater than the volume of the crossover passage.

Related aspects of at least one embodiment of the invention provide an engine, e.g., as described above, in which the crossover passage comprises a plurality of crossover passages. In one embodiment, each of the plurality of crossover passages can be selectively deactivated to reduce an overall volume of the crossover passage.

In another aspect of at least one embodiment of the invention, an engine is provided that includes a crankshaft rotatable about a crankshaft axis, a compression piston slidably received within a compression cylinder and operatively connected to the crankshaft such that the compression piston reciprocates through an intake stroke and a compression stroke during a single rotation of the crankshaft, and an expansion piston slidably received within an expansion cylinder and operatively connected to the crankshaft such that the expansion piston reciprocates through an expansion stroke and an exhaust stroke during a single rotation of the crankshaft. The engine also includes a crossover passage interconnecting the compression and expansion cylinders, the crossover passage including at least one valve. The maximum aggregate volume of the compression cylinder, the expansion cylinder, and the crossover passage is at least 8 times greater than the volume of the crossover passage.

Related aspects of at least one embodiment of the invention provide an engine, e.g., as described above, in which the maximum aggregate volume of the compression cylinder, the expansion cylinder, and the crossover passage is at least 10 times greater than and/or at least 15 times greater than the volume of the crossover passage.

Related aspects of at least one embodiment of the invention provide an engine, e.g., as described above, in which the maximum aggregate volume of the compression cylinder, the expansion cylinder, and the crossover passage is about 18.9 times greater than the volume of the crossover passage.

Related aspects of at least one embodiment of the invention provide an engine, e.g., as described above, in which the crossover passage comprises a plurality of crossover passages. In one embodiment, each of the plurality of crossover passages can be selectively deactivated to reduce an overall volume of the crossover passage.

In another aspect of at least one embodiment of the invention, an engine is provided that includes a crankshaft rotatable about a crankshaft axis, a compression piston slidably received within a compression cylinder and operatively connected to the crankshaft such that the compression piston reciprocates through an intake stroke and a compression stroke during a single rotation of the crankshaft, and an expansion piston slidably received within an expansion cylinder and operatively connected to the crankshaft such that the expansion piston reciprocates through an expansion stroke and an exhaust stroke during a single rotation of the crankshaft. The engine also includes a crossover passage interconnecting the compression and expansion cylinders, the crossover passage including at least one valve. The combined volume of the compression cylinder, the expansion cylinder, and the crossover passage at effective top dead center is less than 4 times the volume of the crossover passage.

Related aspects of at least one embodiment of the invention provide an engine, e.g., as described above, in which the combined volume of the compression cylinder, the expansion cylinder, and the crossover passage at effective top dead center is less than 3 times and/or less than 2 times the volume of the crossover passage.

Related aspects of at least one embodiment of the invention provide an engine, e.g., as described above, in which the combined volume of the compression cylinder, the expansion cylinder, and the crossover passage at effective top dead center is about 1.5 times the volume of the crossover passage.

Related aspects of at least one embodiment of the invention provide an engine, e.g., as described above, in which the crossover passage comprises a plurality of crossover passages. In one embodiment, each of the plurality of crossover passages can be selectively deactivated to reduce an overall volume of the crossover passage.

In another aspect of at least one embodiment of the invention, an engine is provided that includes a crankshaft rotatable about a crankshaft axis, a compression piston slidably received within a compression cylinder and operatively connected to the crankshaft such that the compression piston reciprocates through an intake stroke and a compression stroke during a single rotation of the crankshaft, and an expansion piston slidably received within an expansion cylinder and operatively connected to the crankshaft such that the expansion piston reciprocates through an expansion stroke and an exhaust stroke during a single rotation of the crankshaft. The engine also includes a crossover passage interconnecting the compression and expansion cylinders, the crossover passage including at least one valve. The maximum aggregate volume of the compression cylinder and the expansion cylinder is at least 8 times greater than the volume of the crossover passage, and the combined volume of the compression cylinder, the expansion cylinder, and the crossover passage at effective top dead center is less than 4 times the volume of the crossover passage.

Related aspects of at least one embodiment of the invention provide an engine, e.g., as described above, in which the maximum aggregate volume of the compression cylinder and the expansion cylinder is at least 10 times greater than the volume of the crossover passage, and the combined volume of the compression cylinder, the expansion cylinder, and the crossover passage at effective top dead center is less than 3 times the volume of the crossover passage.

Related aspects of at least one embodiment of the invention provide an engine, e.g., as described above, in which the maximum aggregate volume of the compression cylinder and the expansion cylinder is at least 15 times greater than the volume of the crossover passage, and the combined volume of the compression cylinder, the expansion cylinder, and the crossover passage at effective top dead center is less than 2 times the volume of the crossover passage.

Related aspects of at least one embodiment of the invention provide an engine, e.g., as described above, in which the crossover passage comprises a plurality of crossover passages. In one embodiment, each of the plurality of crossover passages can be selectively deactivated to reduce an overall volume of the crossover passage.

The present invention further provides devices, systems, and methods as claimed.

BRIEF DESCRIPTION OF THE DRAWINGS

The invention will be more fully understood from the following detailed description taken in conjunction with the accompanying drawings, in which.

DETAILED DESCRIPTION

Figure 1:
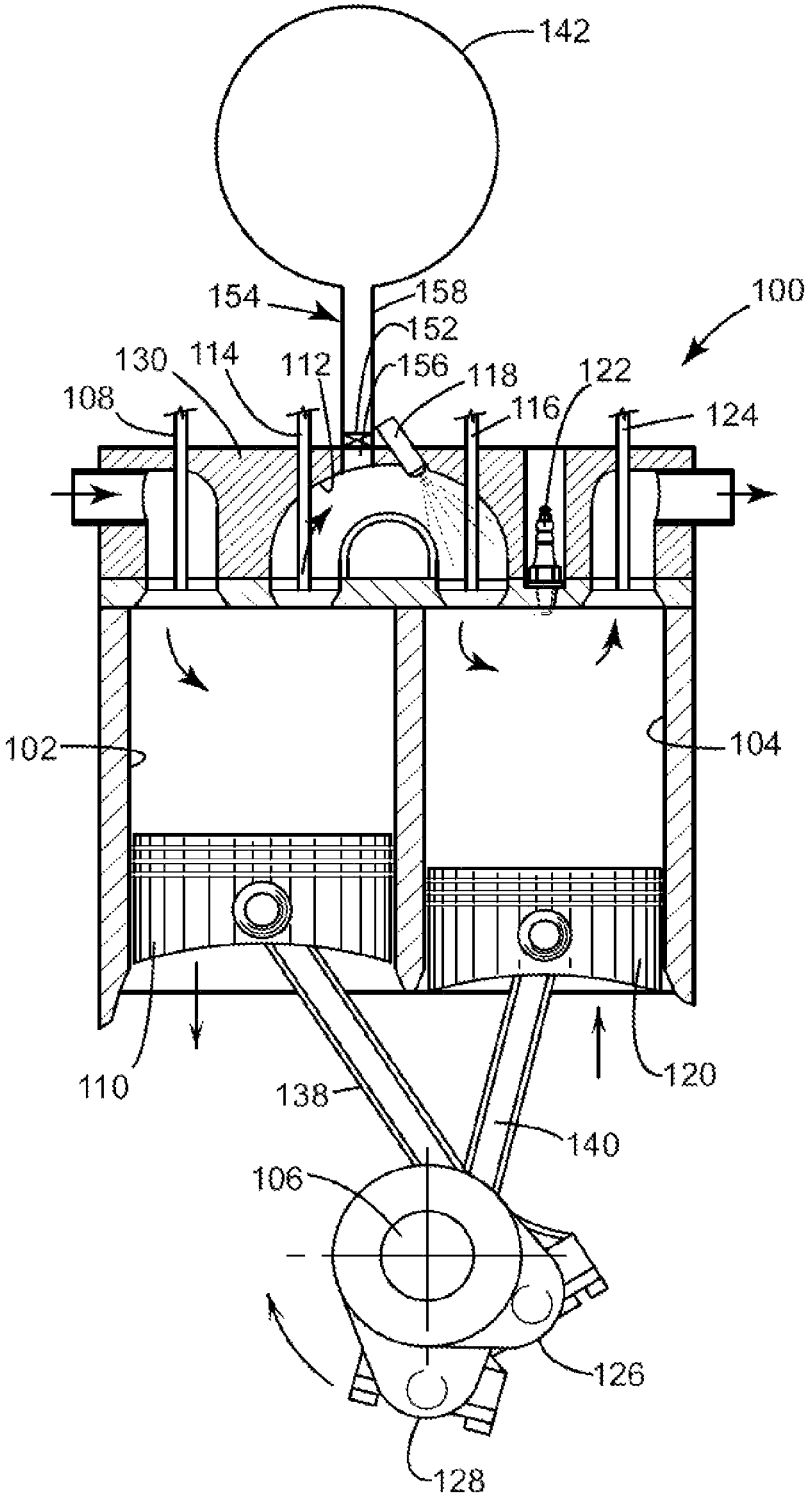
FIG. 1 (PRIOR ART)
FIG. 1 is a schematic diagram of a prior art split-cycle air hybrid engine.

Certain exemplary embodiments will now be described to provide an overall understanding of the principles of the structure, function, manufacture, and use of the methods, systems, and devices disclosed herein. One or more examples of these embodiments are illustrated in the accompanying drawings. Those skilled in the art will understand that the methods, systems, and devices specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

The term "air" is used herein to refer both to air and mixtures of air and other substances such as fuel or exhaust products. The term "fluid" is used herein to refer to both liquids and gasses. Features shown in a particular figure that are the same as, or similar to, features shown in another figure are designated by like reference numerals.

Figure 2:
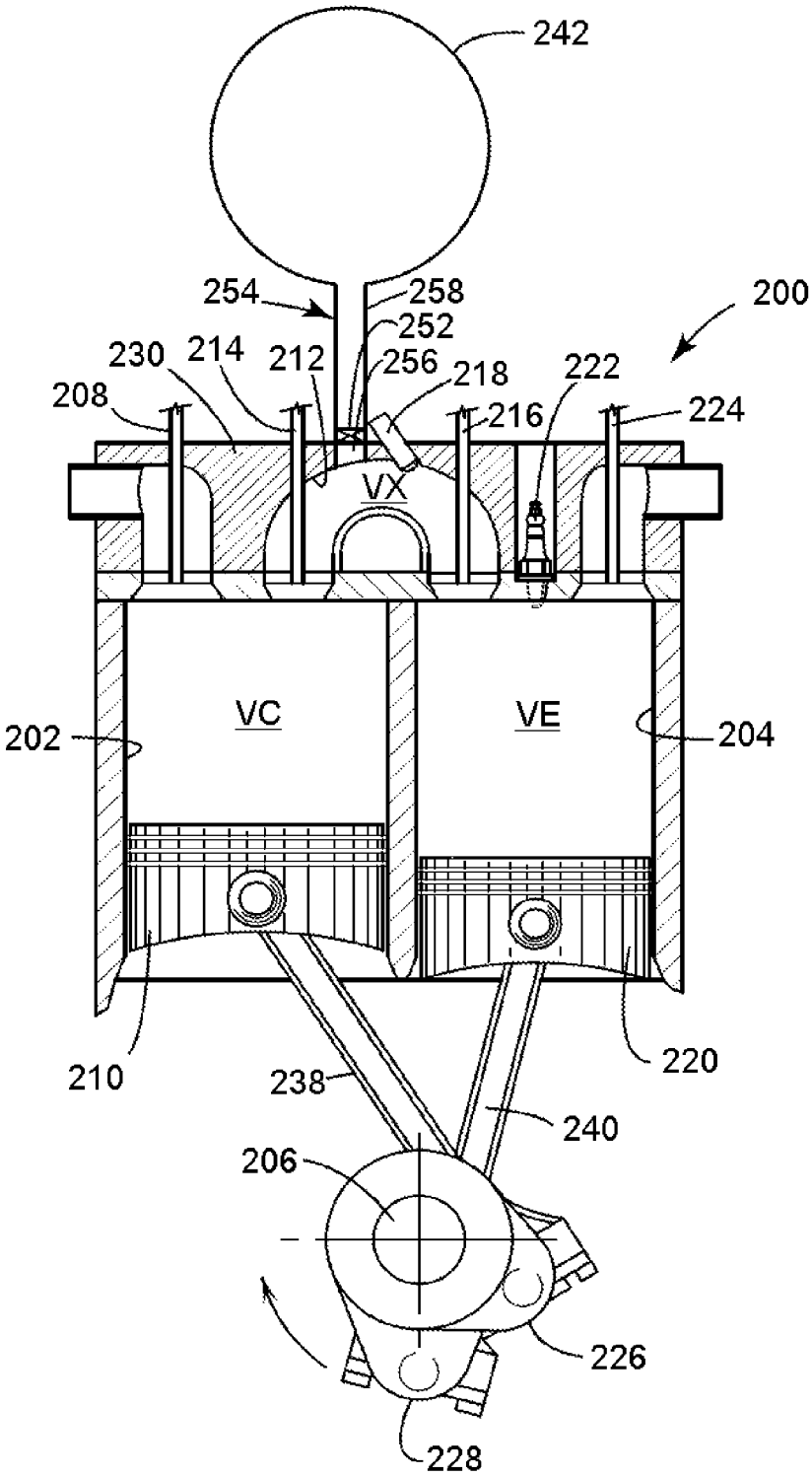
FIG. 2 is a schematic diagram of one embodiment of a split-cycle air hybrid engine in which the crossover passage volume is sized relative to the cylinder volume to improve efficiency.

FIG. 2 illustrates one exemplary embodiment of an air hybrid split-cycle engine 200 according to the present invention. A detailed description of the structure and operation of the engine 200 is omitted here for the sake of brevity, it being understood that the structure and operation of the engine 200 is similar to that of the engine 100 of FIG. 1, except as described herein. The engine 200 of FIG. 2 differs from the engine 100 of FIG. 1 particularly with regard to the sizing of the various engine components (e.g., the volume of the crossover passage relative to the volume of the engine cylinders). The particular sizing arrangements disclosed herein produce an unexpected and substantial increase in engine efficiency.

The engine 200 includes a compression cylinder 202 with a compression piston 210 reciprocally disposed therein and an expansion cylinder 204 with an expansion piston 220 reciprocally disposed therein. Upper ends of the cylinders 202, 204 are closed by a cylinder head 230. During the intake stroke, intake air is drawn into the compression cylinder 202 through an intake valve 208. During the compression stroke, the compression piston 210 pressurizes the air charge and drives the air charge through a crossover passage 212, which acts as the intake passage for the expansion cylinder 204. The engine 200 can have one or more crossover passages 212. An outwardly-opening crossover compression valve 214 at the inlet of the crossover passage 212 is used to control flow from the compression cylinder 202 into the crossover passage 212. An outwardly-opening crossover expansion valve 216 at the outlet of the crossover passage 212 controls flow from the crossover passage 212 into the expansion cylinder 204.

At least one fuel injector 218 injects fuel into the pressurized air at the exit end of the crossover passage 212 and/or directly into the expansion cylinder 204. As the expansion piston 220 begins its descent from its TDC position, one or more spark plugs 222 are fired to initiate combustion, which drives the expansion piston 220 downward in a power stroke. Exhaust gases are pumped out of the expansion cylinder 204 through an exhaust valve 224 during the exhaust stroke.

The compression cylinder 202 has a volume VC defined by the top surface of the compression piston 210, the cylindrical inner sidewall of the compression cylinder 202, and the firing deck of the cylinder head 230. The volume VC of the compression cylinder thus varies depending on the position of the compression piston 210. In particular, the volume VC ranges from a minimum value $VC_{MIN}$ when the compression piston 210 is at its TDC position to a maximum value $VC_{MAX}$ when the compression piston 210 is at its BDC position. For purposes herein, the volume VC of the compression cylinder is specified as though the intake valve 208 and crossover compression valve 214 are always in a closed position, though of course these valves open and close at various points in the engine cycle. Thus, the volume VC does not include the volume of the crossover passage.

The expansion cylinder 204 has a volume VE defined by the top surface of the expansion piston 220, the cylindrical inner sidewall of the expansion cylinder 204, and the firing deck of the cylinder head 230. The volume VE of the expansion cylinder thus varies depending on the position of the expansion piston 220. In particular, the volume VE ranges from a minimum value $VE_{MIN}$ when the expansion piston 220 is at its TDC position to a maximum value $VE_{MAX}$ when the expansion piston 220 is at its BDC position. For purposes herein, the volume VE of the expansion cylinder is specified as though the exhaust valve 224 and crossover expansion valve 216 are always in a closed position, though of course these valves open and close at various points in the engine cycle. Thus, the volume VE does not include the volume of the crossover passage.

Figure 3:
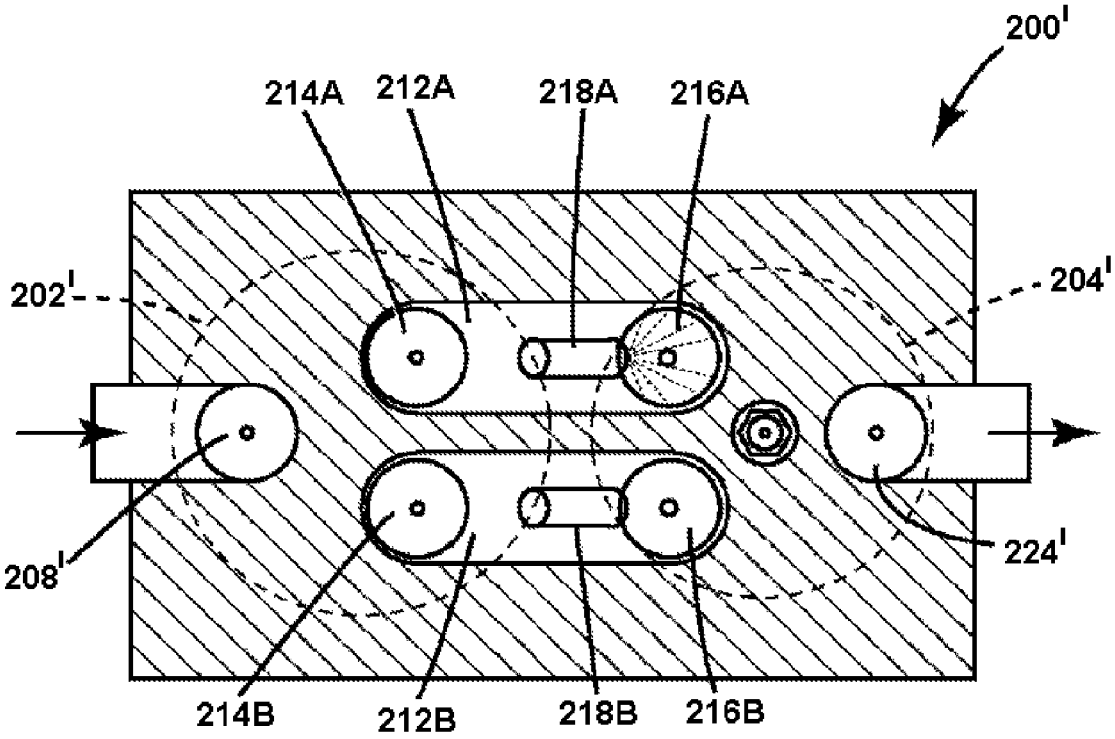
FIG. 3 is a schematic diagram of one embodiment of a split-cycle engine having a plurality of crossover passages.
Figure 4:
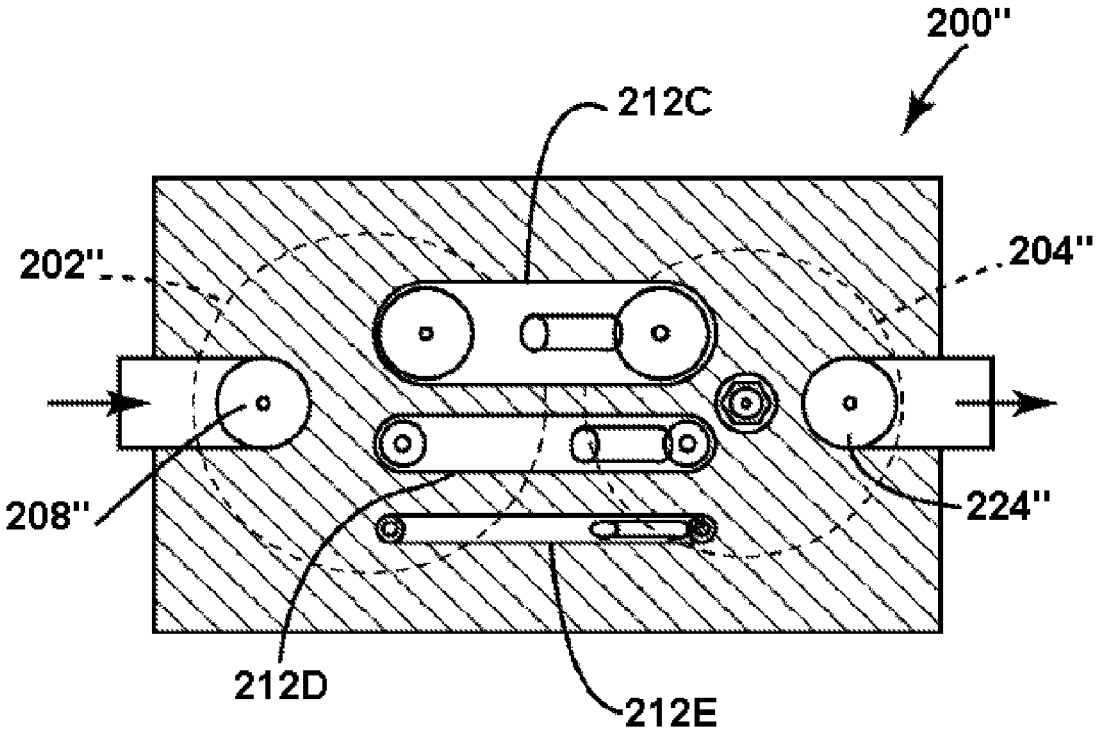
FIG. 4 is a schematic diagram of another embodiment of a split-cycle engine having a plurality of crossover passages.

In the engine 200 of FIG. 2, the crossover passage 212 has a fixed volume VX defined by its interior surfaces. For purposes herein, the volume VX of the crossover passage is specified as though the crossover compression valve 214, the crossover expansion valve 216, and the air tank valve 252 are always in a closed position, though of course these valves open and close at various points in the engine cycle. Although the crossover passage volume VX is fixed in the illustrated embodiment, it will be appreciated that crossover passage volume VX can also be variable. For example, as shown in FIG. 3, an engine 200' can have a crossover passage that includes first and second crossover passages 212A, 212B, each of which can be selectively deactivated to vary the overall crossover passage volume. By deactivating the crossover passage 212B (e.g., by deactivating one or more valves associated therewith), the overall crossover passage volume is reduced by 50%. By way of further example, as shown in FIG. 4, an engine 200" can have a crossover passage that includes first, second, and third crossover passages 212C, 212D, 212E. In this embodiment, each of the crossover passages has a different volume, and can be selectively activated or deactivated (e.g., by activating or deactivating one or more valves associated therewith) to vary the crossover passage volume across a range of volumes between a minimum volume (e.g., when only the crossover passage 212E is active) to a maximum volume (e.g., when all three crossover passages 212C, 212D, 212E are active).

In any of the embodiments disclosed herein, each discrete crossover passage can also have an adjustable and/or variable volume, for example as described in U.S. Publication No. 2010/0263646, published on Oct. 21, 2010, and entitled "Variable Volume Crossover Passage for Split-Cycle Engine," the entire contents of which are incorporated herein by reference.

Referring again to FIG. 2, it will be appreciated that volume VC of the compression cylinder 202 and the volume VE of the expansion cylinder 204 vary based on the position of their respective pistons 210, 220. As a result, the aggregate cylinder volume VCE=VC+VE changes across the engine cycle, as does the aggregate crossover passage and cylinder volume VXCE=VC+VE+VX.

For purposes herein, the "effective TDC" of an engine is the crankshaft position at which the aggregate crossover passage and cylinder volume VXCE is at a minimum. In the engine 200 of FIG. 2, effective TDC occurs approximately halfway between TDC of the expansion piston 220 and TDC of the compression piston 210. In other words, the aggregate crossover passage and cylinder volume VXCE is at a minimum in the engine 200 of FIG. 2 as the compression piston 210 is ascending, just before it reaches its TDC position, and as the expansion piston 220 is descending, just after it reaches its TDC position.

Also for purposes herein, the "effective BDC" of an engine is the crankshaft position at which the aggregate crossover passage and cylinder volume VXCE is at a maximum. In the engine 200 of FIG. 2, effective BDC occurs approximately halfway between BDC of the expansion piston 220 and BDC of the compression piston 210. In other words, the aggregate crossover passage and cylinder volume VXCE is at a maximum in the engine 200 of FIG. 2 as the compression piston 210 is descending, just before it reaches its BDC position, and as the expansion piston 220 is ascending, just after it reaches its BDC position.

Also for purposes herein, the effective compression ratio of an engine is defined as the ratio of the maximum aggregate crossover passage and cylinder volume $VXCE_{MAX}$ to the minimum aggregate crossover passage and cylinder volume $VXCE_{MIN}$ (the ratio of total crossover passage and cylinder volume at effective BDC to total crossover passage and cylinder volume at effective TDC). In one embodiment, the effective compression ratio of the engine is about 15:1.

During operation of the engine 200, the crossover expansion valve 216 opens shortly before the expansion piston 220 reaches its TDC position. At this time, the pressure ratio of the pressure in crossover passage 212 to the pressure in expansion cylinder 204 is high, due to the fact that the minimum pressure in the crossover passage 212 is typically twenty bar absolute or higher and the pressure in the expansion cylinder 204 during the exhaust stroke is typically about one to two bar absolute. In other words, when the crossover expansion valve 216 opens, the pressure in crossover passage 212 is substantially higher than the pressure in the expansion cylinder 204 (typically in the order of 20 to 1 or greater). This high pressure ratio causes initial flow of the air and/or fuel charge to flow from the crossover passage 212 and into the expansion cylinder 204 at high speeds. These high flow speeds can reach the speed of sound, which is referred to as sonic flow. This sonic flow is particularly advantageous in the engine 200 because it leads to intense turbulence which promotes good air/fuel mixing leading to rapid and efficient combustion.

To optimize the efficiency of the engine 200, it is desirable to maximize the duration of this sonic flow. Sonic velocity of the air entering the expansion cylinder 204 when the crossover expansion valve 216 is initially opened is achieved by maintaining the pressure in the crossover passage 212 at a level that is higher than the pressure in the expansion cylinder 204 during the exhaust stroke. A sonic flow ratio is defined as the ratio of the pressure in the crossover passage 212 to the pressure in the expansion cylinder 204 necessary to achieve sonic flow.

In the AEF and AE modes of the engine 200, a high pressure in the crossover passage 212 is maintained by keeping the pressure in the air tank 242 at or above 5 bar, preferably above 7 bar, and more preferably above 10 bar. In the EF and FC modes of the engine 200, a high pressure in the crossover passage 212 is maintained by utilizing the push-pull method of gas transfer described above. The pressure in the crossover passage 212 can be further increased, however, by appropriate sizing of the various components of the engine 200.

For example, the crossover passage volume VX can be made small compared to the maximum compression cylinder volume $VC_{MAX}$. Preferably, the maximum volume $VC_{MAX}$ of the compression cylinder 202 is at least two times greater than the volume VX of the crossover passage 212. More preferably, the maximum volume $VC_{MAX}$ of the compression cylinder 202 is at least four times greater than the volume VX of the crossover passage 212. Even more preferably, the maximum volume $VC_{MAX}$ of the compression cylinder 202 is at least six times greater than the volume VX of the crossover passage 212. Still more preferably, the maximum volume $VC_{MAX}$ of the compression cylinder 202 is at least eight times greater than the volume VX of the crossover passage 212. When the maximum volume $VC_{MAX}$ of the compression cylinder 202 is large compared to the crossover passage volume VX, the intake air charge is compressed to a higher degree during the compression stroke, thereby increasing the pressure in the crossover passage 212. In other words, the effective compression ratio is high, which results in a longer duration of sonic flow and commensurate improvements in engine efficiency.

By way of further example, the crossover passage volume VX can be made small compared to the maximum expansion cylinder volume $VE_{MAX}$. Preferably, the maximum volume $VE_{MAX}$ of the expansion cylinder 204 is at least two times greater than the volume VX of the crossover passage 212. More preferably, the maximum volume $VE_{MAX}$ of the expansion cylinder 204 is at least four times greater than the volume VX of the crossover passage 212. Even more preferably, the maximum volume $VE_{MAX}$ of the expansion cylinder 204 is at least six times greater than the volume VX of the crossover passage 212. Still more preferably, the maximum volume $VE_{MAX}$ of the expansion cylinder 204 is at least eight times greater than the volume VX of the crossover passage 212.

As another example, the crossover passage volume VX can be made small compared to the maximum aggregate cylinder volume $VCE_{MAX}$. Preferably, the maximum aggregate cylinder volume $VCE_{MAX}$ is at least eight times greater than the volume VX of the crossover passage. More preferably, the maximum aggregate cylinder volume $VCE_{MAX}$ is at least ten times greater than the volume VX of the crossover passage. Even more preferably, the maximum aggregate cylinder volume $VCE_{MAX}$ is at least fifteen times greater than the volume VX of the crossover passage.

By way of further example, the crossover passage volume VX can be made small compared to the maximum aggregate crossover passage and cylinder volume $VXCE_{MAX}$. Preferably, the maximum aggregate crossover passage and cylinder volume $VXCE_{MAX}$ is at least eight times greater than the volume VX of the crossover passage. More preferably, the maximum aggregate crossover passage and cylinder volume $VXCE_{MAX}$ is at least ten times greater than the volume VX of the crossover passage. Even more preferably, the maximum aggregate crossover passage and cylinder volume $VXCE_{MAX}$ is at least fifteen times greater than the volume VX of the crossover passage.

The aggregate cylinder volume VCE and the aggregate crossover passage and cylinder volume VXCE are significant because in the push-pull method, both the crossover compression valve 214 and the crossover expansion valve 216 are open when a mass of air is transferred through the crossover passage 212. Hence, the volume of both the compression cylinder 202 and the expansion cylinder 204 are simultaneously in communication with the crossover passage 212 during the push-pull portion of the engine cycle. During this push-pull period, a crossover passage 212 having a volume VX that is small relative to the maximum aggregate cylinder volume $VCE_{MAX}$ and/or relative to the maximum aggregate crossover passage and cylinder volume $VXCE_{MAX}$ essentially acts as a flow restriction between the compression cylinder 202 and the expansion cylinder 204, which generates a dramatic increase in the velocity of air as it enters the expansion cylinder 204.

As another example, the minimum aggregate crossover passage and cylinder volume $VXCE_{MIN}$ (e.g., the aggregate crossover passage and cylinder volume at effective TDC) can be minimized so as not to greatly exceed the crossover passage volume VX. In other words, in order to maintain a high pressure in the crossover passage 212, the total volume of the compression cylinder 202, expansion cylinder 204, and crossover passage 212 at effective TDC can be less than 4 times the volume of the crossover passage, preferably less than 3 times the volume of the crossover passage, and more preferably less than 2 times the volume of the crossover passage. In one embodiment, the aggregate crossover passage and cylinder volume $VXCE_{MIN}$ at effective TDC approaches the volume of the crossover passage 212 because at actual TDC of the compression and expansion pistons 210, 220, the volumes of the compression and expansion cylinders 202, 204 are very small. In other words, the geometric compression ratio of the compression cylinder 202 is approximately 95:1 and the geometric expansion ratio of the expansion cylinder 204 is approximately 50:1, meaning that there is a small, tight clearance between the compression and expansion pistons 210, 220 and the cylinder head 230 (specifically, the fire deck of the head) at the pistons' respective TDC positions. These narrow clearance spaces at TDC of the respective pistons 210, 220 translate into an aggregate crossover passage and cylinder volume $VXCE_{MIN}$ at effective TDC that does not greatly exceed the crossover passage volume VX.

It will be appreciated that the increase in crossover passage pressure obtained by sizing the various engine components as described above results in an increase in the sonic flow period of the mass of air that enters the expansion cylinder, thereby increasing the efficiency of the engine.

Figure 5:
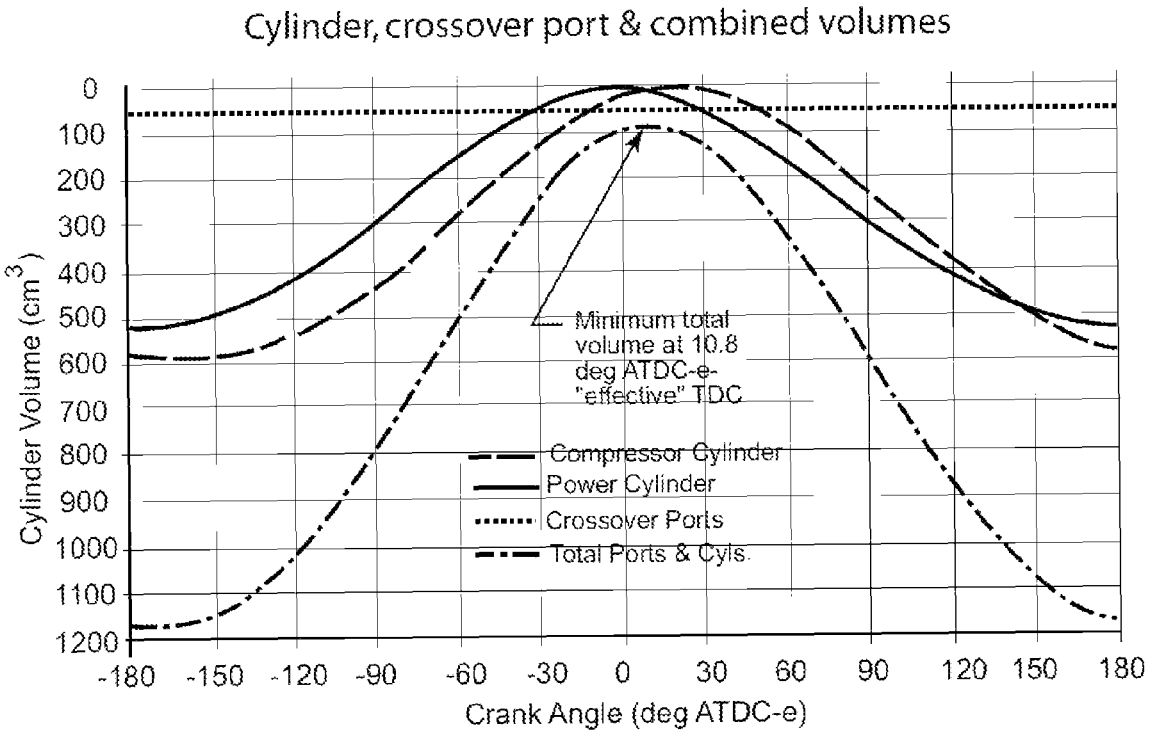
FIG. 5 is a graphical illustration of compression cylinder volume, expansion cylinder volume, crossover passage volume, and total crossover passage and cylinder volume as a function of crank angle degrees after top dead center of the expansion piston in one exemplary embodiment of a split-cycle engine.

FIG. 5 illustrates the volumes of the respective components of one exemplary embodiment of a split-cycle engine (expressed in terms of cubic centimeters "cc") plotted across the engine's operating cycle (expressed in terms of crank angle degrees after top dead center of the expansion piston "deg ATDC-e").

As shown, the compression cylinder has a maximum volume of about 590 cc at about −160 deg ATDC-e. The compression cylinder has a minimum volume of about 6 cc at about 20 deg ATDC-e. The expansion cylinder (or "power cylinder") has a maximum volume of about 540 cc at about 180 deg ATDC-e. The expansion cylinder has a minimum volume of about 11 cc at about 0 deg ATDC-e. The crossover passage (or "crossover port") has a fixed volume of about 62 cc across the entire engine cycle. The aggregate crossover passage and cylinder volume has a maximum value of about 1170 cc at about −170 deg ATDC-e (effective BDC). The aggregate crossover passage and cylinder volume has a minimum value of about 90 cc at about 10.8 deg ATDC-e (effective TDC).

Thus, in the engine of FIG. 5, the maximum compression cylinder volume $VC_{MAX}$ is about 9.5 times greater than the crossover passage volume VX. The maximum expansion cylinder volume $VE_{MAX}$ is about 8.7 times greater than the crossover passage volume VX. The maximum aggregate crossover passage and cylinder volume $VXCE_{MAX}$ is about 18.9 times greater than the crossover passage volume VX. The minimum aggregate crossover passage and cylinder volume $VXCE_{MIN}$ is about 1.5 times greater than the crossover passage volume VX. The maximum aggregate cylinder volume $VCE_{MAX}$ is about 17.7 times greater than the volume of the crossover passage. Using these sizing parameters, the engine of FIG. 5 achieves high crossover passage pressure throughout the engine cycle, which increases the period of sonic flow and generates an improvement in overall engine efficiency.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. An engine comprising:

a crankshaft rotatable about a crankshaft axis;

a compression piston slidably received within a compression cylinder and operatively connected to the crankshaft such that the compression piston reciprocates through an intake stroke and a compression stroke during a single rotation of the crankshaft;

an expansion piston slidably received within an expansion cylinder and operatively connected to the crankshaft such that the expansion piston reciprocates through an expansion stroke and an exhaust stroke during a single rotation of the crankshaft; and a crossover passage interconnecting the compression and expansion cylinders, the crossover passage including at least one valve;

wherein the maximum aggregate volume of the compression cylinder and the expansion cylinder is at least 8 times greater than the volume of the crossover passage, and the combined volume of the compression cylinder, the expansion cylinder, and the crossover passage at effective top dead center is less than 4 times the volume of the crossover passage.

2. The engine of claim 1, wherein the maximum aggregate volume of the compression cylinder and the expansion cylinder is at least 10 times greater than the volume of the crossover passage, and the combined volume of the compression cylinder, the expansion cylinder, and the crossover passage at effective top dead center is less than 3 times the volume of the crossover passage.

3. The engine of claim 1, wherein the maximum aggregate volume of the compression cylinder and the expansion cylinder is at least 15 times greater than the volume of the crossover passage, and the combined volume of the compression cylinder, the expansion cylinder, and the crossover passage at effective top dead center is less than 2 times the volume of the crossover passage.

4. An engine comprising:

a crankshaft rotatable about a crankshaft axis;

a compression piston slidably received within a compression cylinder and operatively connected to the crankshaft such that the compression piston reciprocates through an intake stroke and a compression stroke during a single rotation of the crankshaft;

an expansion piston slidably received within an expansion cylinder and operatively connected to the crankshaft such that the expansion piston reciprocates through an expansion stroke and an exhaust stroke during a single rotation of the crankshaft; and a crossover passage interconnecting the compression and expansion cylinders, the crossover passage including at least one valve;

wherein the maximum volume of the compression cylinder is at least 2 times greater than the volume of the crossover passage;

wherein the crossover passage comprises a plurality of crossover passages;

wherein each of the plurality of crossover passages can be selectively deactivated by deactivating at least one of a crossover compression valve that controls fluid communication between the compression cylinder and said crossover passage and a crossover expansion valve that controls fluid communication between the expansion cylinder and said crossover passage to reduce an overall volume of the plurality of crossover passages.

5. The engine of claim 4, wherein the maximum volume of the compression cylinder is at least 4 times greater than the volume of the crossover passage.

6. The engine of claim 4, wherein the maximum volume of the compression cylinder is at least 6 times greater than the volume of the crossover passage.

7. The engine of claim 4, wherein the maximum volume of the compression cylinder is at least 8 times greater than the volume of the crossover passage.

8. The engine of claim 4, wherein the maximum volume of the compression cylinder is about 9.5 times greater than the volume of the crossover passage.

9. An engine comprising:

a crankshaft rotatable about a crankshaft axis;

a compression piston slidably received within a compression cylinder and operatively connected to the crankshaft such that the compression piston reciprocates through an intake stroke and a compression stroke during a single rotation of the crankshaft;

an expansion piston slidably received within an expansion cylinder and operatively connected to the crankshaft such that the expansion piston reciprocates through an expansion stroke and an exhaust stroke during a single rotation of the crankshaft; and a crossover passage interconnecting the compression and expansion cylinders, the crossover passage including at least one valve;

wherein the maximum volume of the expansion cylinder is at least 2 times greater than the volume of the crossover passage;

wherein the crossover passage comprises a plurality of crossover passages;

wherein each of the plurality of crossover passages can be selectively deactivated by deactivating at least one of a crossover compression valve that controls fluid communication between the compression cylinder and said crossover passage and a crossover expansion valve that controls fluid communication between the expansion cylinder and said crossover passage to reduce an overall volume of the plurality of crossover passages.

10. The engine of claim 9, wherein the maximum volume of the expansion cylinder is at least 4 times greater than the volume of the crossover passage.

11. The engine of claim 9, wherein the maximum volume of the expansion cylinder is at least 6 times greater than the volume of the crossover passage.

12. The engine of claim 9, wherein the maximum volume of the expansion cylinder is at least 8 times greater than the volume of the crossover passage.

13. The engine of claim 9, wherein the maximum volume of the expansion cylinder is about 8.7 times greater than the volume of the crossover passage.

14. An engine comprising:

a crankshaft rotatable about a crankshaft axis;

a compression piston slidably received within a compression cylinder and operatively connected to the crankshaft such that the compression piston reciprocates through an intake stroke and a compression stroke during a single rotation of the crankshaft;

an expansion piston slidably received within an expansion cylinder and operatively connected to the crankshaft such that the expansion piston reciprocates through an expansion stroke and an exhaust stroke during a single rotation of the crankshaft; and a crossover passage interconnecting the compression and expansion cylinders, the crossover passage including at least one valve;

wherein the maximum aggregate volume of the compression cylinder and the expansion cylinder is at least 8 times greater than the volume of the crossover passage;

wherein the crossover passage comprises a plurality of crossover passages;

wherein each of the plurality of crossover passages can be selectively deactivated by deactivating at least one of a crossover compression valve that controls fluid communication between the compression cylinder and said crossover passage and a crossover expansion valve that controls fluid communication between the expansion cylinder and said crossover passage to reduce an overall volume of the plurality of crossover passages.

15. The engine of claim 14, wherein the maximum aggregate volume of the compression cylinder and the expansion cylinder is at least 10 times greater than the volume of the crossover passage.

16. The engine of claim 14, wherein the maximum aggregate volume of the compression cylinder and the expansion cylinder is at least 15 times greater than the volume of the crossover passage.

17. The engine of claim 14, wherein the maximum aggregate volume of the compression cylinder and the expansion cylinder is about 17.7 times greater than the volume of the crossover passage.

18. An engine comprising:

a crankshaft rotatable about a crankshaft axis;

a compression piston slidably received within a compression cylinder and operatively connected to the crankshaft such that the compression piston reciprocates through an intake stroke and a compression stroke during a single rotation of the crankshaft;

an expansion piston slidably received within an expansion cylinder and operatively connected to the crankshaft such that the expansion piston reciprocates through an expansion stroke and an exhaust stroke during a single rotation of the crankshaft; and a crossover passage interconnecting the compression and expansion cylinders, the crossover passage including at least one valve;

wherein the maximum aggregate volume of the compression cylinder, the expansion cylinder, and the crossover passage is at least 8 times greater than the volume of the crossover passage;

wherein the crossover passage comprises a plurality of crossover passages;

wherein each of the plurality of crossover passages can be selectively deactivated by deactivating at least one of a crossover compression valve that controls fluid communication between the compression cylinder and said crossover passage and a crossover expansion valve that controls fluid communication between the expansion cylinder and said crossover passage to reduce an overall volume of the plurality of crossover passages.

19. The engine of claim 18, wherein the maximum aggregate volume of the compression cylinder, the expansion cylinder, and the crossover passage is at least 10 times greater than the volume of the crossover passage.

20. The engine of claim 18, wherein the maximum aggregate volume of the compression cylinder, the expansion cylinder, and the crossover passage is at least 15 times greater than the volume of the crossover passage.

21. The engine of claim 18, wherein the maximum aggregate volume of the compression cylinder, the expansion cylinder, and the crossover passage is about 18.9 times greater than the volume of the crossover passage.

22. An engine comprising:

a crankshaft rotatable about a crankshaft axis;

a compression piston slidably received within a compression cylinder and operatively connected to the crankshaft such that the compression piston reciprocates through an intake stroke and a compression stroke during a single rotation of the crankshaft;

an expansion piston slidably received within an expansion cylinder and operatively connected to the crankshaft such that the expansion piston reciprocates through an expansion stroke and an exhaust stroke during a single rotation of the crankshaft; and a crossover passage interconnecting the compression and expansion cylinders, the crossover passage including at least one valve;

wherein the combined volume of the compression cylinder, the expansion cylinder, and the crossover passage at effective top dead center is less than 4 times the volume of the crossover passage.

23. The engine of claim 22, wherein the combined volume of the compression cylinder, the expansion cylinder, and the crossover passage at effective top dead center is less than 3 times the volume of the crossover passage.

24. The engine of claim 22, wherein the combined volume of the compression cylinder, the expansion cylinder, and the crossover passage at effective top dead center is less than 2 times the volume of the crossover passage.

25. The engine of claim 22, wherein the combined volume of the compression cylinder, the expansion cylinder, and the crossover passage at effective top dead center is about 1.5 times the volume of the crossover passage.

26. The engine of claim 22, wherein the crossover passage comprises a first crossover passage and a second crossover passage.

27. The engine of claim 26, wherein each of the first and second crossover passages can be selectively deactivated by deactivating at least one of a crossover compression valve that controls fluid communication between the compression cylinder and said crossover passage and a crossover expansion valve that controls fluid communication between the expansion cylinder and said crossover passage to reduce the overall volume of the first and second crossover passages.

* * * * *